US005497971A

United States Patent [19]

Spiro

[11] Patent Number: 5,497,971

[45] Date of Patent: Mar. 12, 1996

[54] TRIGONAL PYRAMIDAL BOOKSTAND

[76] Inventor: Alexander C. Spiro, 4103 38th St. NW., Washington, D.C. 20016

[21] Appl. No.: 254,868

[22] Filed: Jun. 6, 1994

[51] Int. Cl.[6] ..... A47G 1/24

[52] U.S. Cl. ..... 248/455; 248/166; 248/464

[58] Field of Search ..... 248/455, 447, 248/460, 462, 463, 464, 431, 432, 441.1, 454, 455, 163.1, 166, 168; 16/282, 287, 302, 365; 403/217, 218, 219, 291, 388, 396

[56] References Cited

U.S. PATENT DOCUMENTS

| | | | |
|---|---|---|---|
| 260,068 | 6/1882 | Van Kirk | 248/463 |
| D. 282,324 | 1/1986 | Ellis | D6/475 |
| 308,535 | 11/1884 | Vail | 248/463 |
| 589,464 | 9/1897 | Church | 248/166 X |
| 881,766 | 9/1906 | Bing . | |
| 1,459,104 | 6/1923 | Johnson . | |
| 1,581,742 | 4/1926 | Johnson | 248/464 |
| 1,824,165 | 8/1931 | Miller . | |
| 2,376,452 | 5/1945 | Rossman | 248/455 |
| 2,973,933 | 3/1961 | Howell | 248/166 |
| 3,145,014 | 8/1964 | Neuwirth | 248/464 |
| 3,201,080 | 8/1965 | Rose | 248/460 |
| 4,553,728 | 11/1985 | Corsello | 248/452 |
| 4,826,125 | 5/1989 | Kelley | 248/463 |
| 4,880,327 | 1/1989 | Sanabria | 402/73 |
| 4,886,231 | 12/1989 | Doerksen | 248/455 |
| 5,016,852 | 5/1991 | Herendeen | 248/461 |
| 5,317,826 | 6/1994 | Underwood | 42/94 |

FOREIGN PATENT DOCUMENTS

| | | | |
|---|---|---|---|
| 73919 | 1/1954 | Netherlands | 248/431 |

*Primary Examiner*—Alvin C. Chin-Shue
*Assistant Examiner*—Korie H. Chan

[57] ABSTRACT

A portable, collapsible bookstand to retain a book or sheets of paper in an upright position is described. The bookshelf is formed from a supporting shelf secured horizontally by two of three legs in a trigonal pyramidal arrangement. The three legs are securely joined at their tops by an elastic loop firmly wound about catches fixed to each leg. The rear leg has partial mobility perpendicular to the shelf so that reading material can be reclined to a desired position. The material at the bottom of each leg has a high coefficient of friction so that the bookstand does not slide on a supporting surface. A small gap between the forelegs and the supporting shelf secures materials placed on the bookshelf. When not in use, the shelf can be disengaged from one front leg and pivoted about its point of attachment to the other front leg, bringing it parallel to the leg to which it is attached. The bookstand can now be collapsed so that the three legs are side by side and parallel to the disengaged shelf.

15 Claims, 3 Drawing Sheets

TRIGONAL PYRAMIDAL BOOKSTAND

BACKGROUND OF THE INVENTION

This invention relates to bookstands, and more particularly to portable collapsible bookstands.

The desirability of having a bookstand that permits placement of a book in a near vertical position to facilitate its reading has long been recognized. This is especially true with regard to reference textbooks.

To date there have been a number of attempts to provide a solution to this need. Unfortunately, all attempts have produced limited products. The majority of previous bookstands are intricate and complicated, and none has satisfied the public so as to be commercially viable. Furthermore, bookstands that can hold large books are bulky and uncomfortable to transport. A small number of collapsible and portable bookstands have been successfully introduced into the marketplace, yet these are weak and flimsy, limiting their use to smaller books. There is still a need for a collapsible, transportable bookstand that is sturdy enough to hold large texts, yet small enough to be comfortably transported.

SUMMARY OF THE INVENTION

Accordingly, the present invention provides for a bookstand that comprises a foldable trigonal pyramidal frame having an apex, the bottom of the frame forming a base, and a shelf attached across one side of said frame, said shelf being adjacent to, and extending across one side of the base of said frame in a manner to support books or papers thereon in juxtaposition to lean against the side of said frame across which the same extends. The three legs join at their apex using an elastic loop that is wound about catches located near the top of each leg.

OBJECTS OF THE INVENTION

It is therefore an object of the present invention to provide a compact and collapsible bookstand.

Yet another object of the present invention is to provide a portable and adjustable bookstand.

It is another object of the invention to provide a lightweight and durable bookstand free from mechanical and material deficiencies.

The foregoing and other objects, advantages, and features of the invention, and the manner in which the same are accomplished, will become more readily apparent upon consideration of the following detailed description of the invention taken in conjunction with the accompanying drawings, wherein:

DETAILED DESCRIPTION

Figures 1, 2:
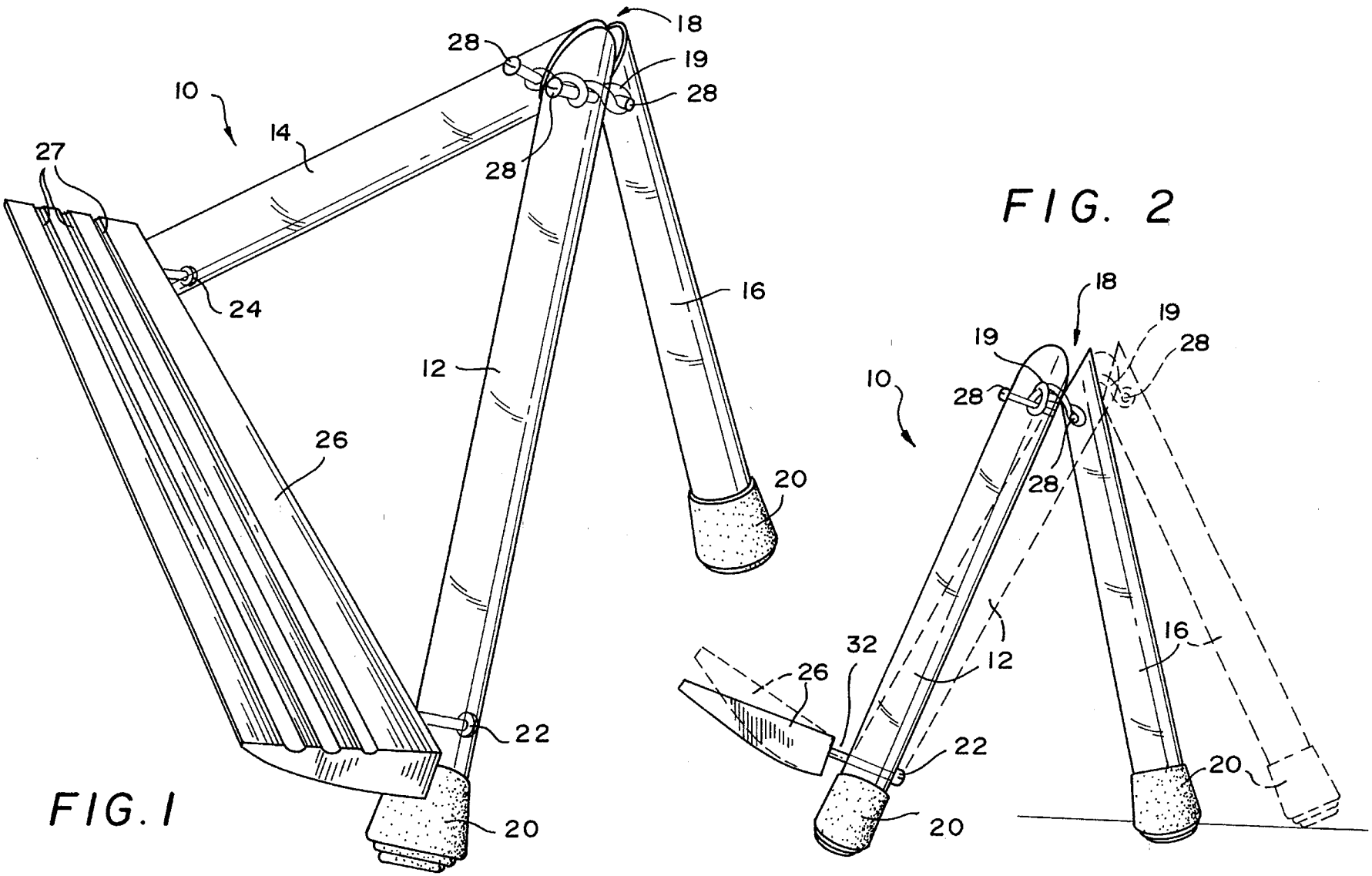
FIG. 1 is a front elevational view of the overall arrangement of the bookstand in the open position according to the present invention.
FIG. 2 is a side view of the bookstand illustrating alternative positions at which it can recline, and the gap between the front legs and the shelf which secures reading material placed on the stand.

Referring to the drawings, wherein like reference numerals designate like or corresponding parts throughout the several views, FIG. 1 illustrates the bookstand of the present invention in the open position.

Bookstand 10 employs three legs 12, 14, and 16 arranged in a trigonal pyramidal form. Legs 12 and 14 comprise the front legs of the bookstand 10, with leg 16 slightly shorter than legs 12 and 14, forming the rear leg. Legs 12, 14, and 16 are joined together at their joint apex 18 in a manner to be discussed hereinafter.

While legs 12, 14, and 16 may comprise any suitable material, the preferred material is clear acrylic tubing, both for its lightweight feature and its attractiveness. The ends of the legs 12, 14, and 16 opposite to that of the ends joined at the apex 18 form the base of the bookstand and are covered with a material of a high coefficient of friction 20, such as rubber, so that the legs don't slide along the surface upon which the bookstand 10 is placed.

Figure 4:
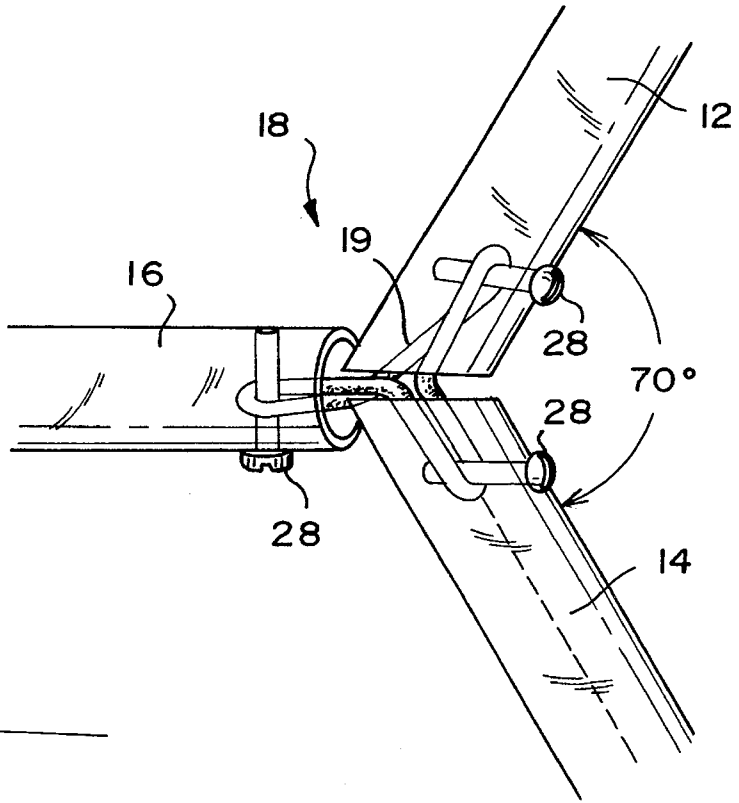
FIG. 4 is the apex of the bookstand.
Figure 5:
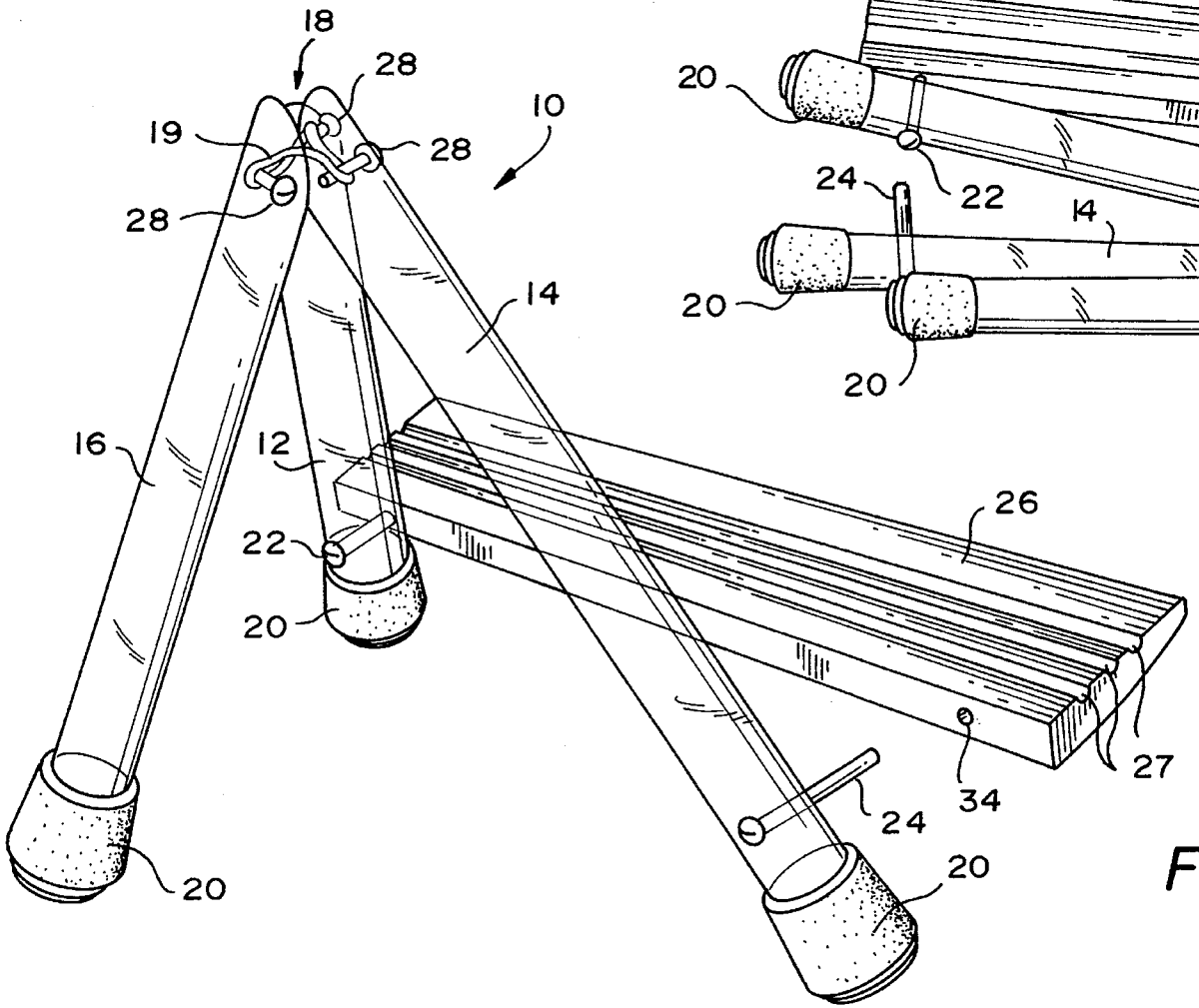
FIG. 5 is a rear elevational view of the overall arrangement of the bookstand showing the detachable peg and its hole in which it is placed to lock the bookstand in the open position according to the present invention.

Front legs 12 and 14 form an angle of approximately 70 degrees relative to each other at apex 18, as shown in FIG. 4. Referring now to FIG. 5, a screw, or peg, 22 is located a short distance from the bottom of leg 12, above the rubber portion 20, and extends forwardly therefrom. A shelf 26 is permanently secured to leg 12 by peg 22 which extends through both the leg and shelf. Shelf 26 is rotatable about peg 22 for reasons to be described hereinafter. A second peg 24, identical to peg 22 is secured to leg 14. Peg 24 is secured to leg 14 at a distance from the bottom of its leg equal to the distance peg 22 is located from the bottom of its leg. Unlike peg 22, it is not permanently attached to shelf 26, but only through leg 14 and forwardly thereof.

Shelf 26 may be of any material, such as wood or molding, and would be of sufficient length to extend from leg 12 to leg 14 when they are extended in the open position of the bookstand 10. The width of shelf 26 may be approximately 2–2½ inches wide, and may be slightly grooved (as shown by grooves 27) to better grip sheets of paper that may be placed thereupon. As seen in FIG. 5, peg 24 is inserted into opening 34 in the back of shelf 26 in order to secure the bookstand 10 in its open position. Referring to FIG. 2, a small gap 32 is formed between leg 12 and 14 and shelf 26 to secure reading material or a binder therebetween.

Figure 3:
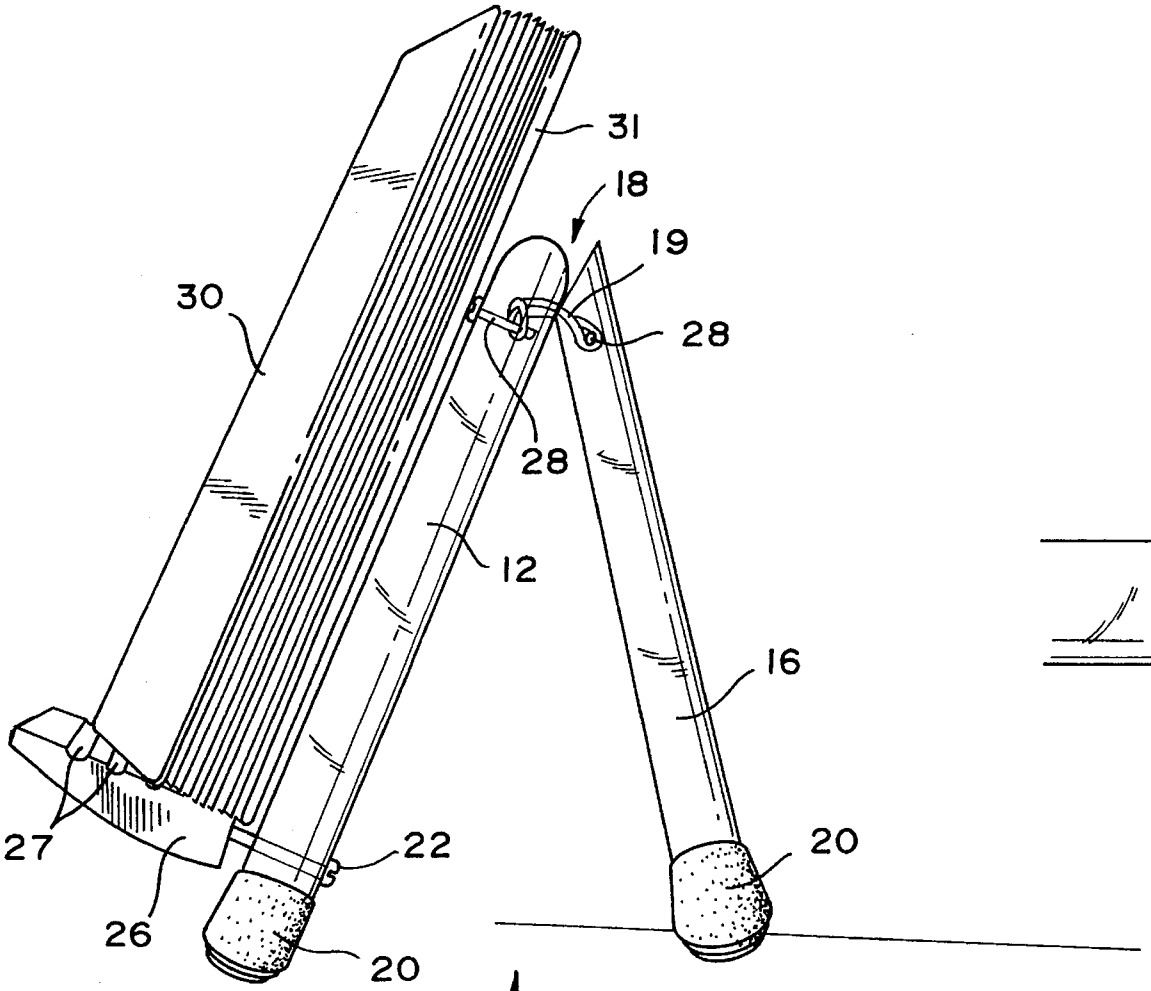
FIG. 3 is a side elevational view of the bookstand holding a book open to be read by a user.

As seen in FIG. 2, rear leg 16 is adjustable relative to front legs 12 and 14 and has mobility to the shelf 26 from 45 to 73 degrees with respect to the plane of the surface the structure is placed on. Rear leg 16 is free to move perpendicular relative to shelf 26 in order to recline a book 30, shown in FIG. 3, to its desired position. While not intended to be limiting, it has been found that a preferred reading position would have legs 12 and 14 at ten inches in length, and rear leg 16 at eight inches in length.

Figure 6:
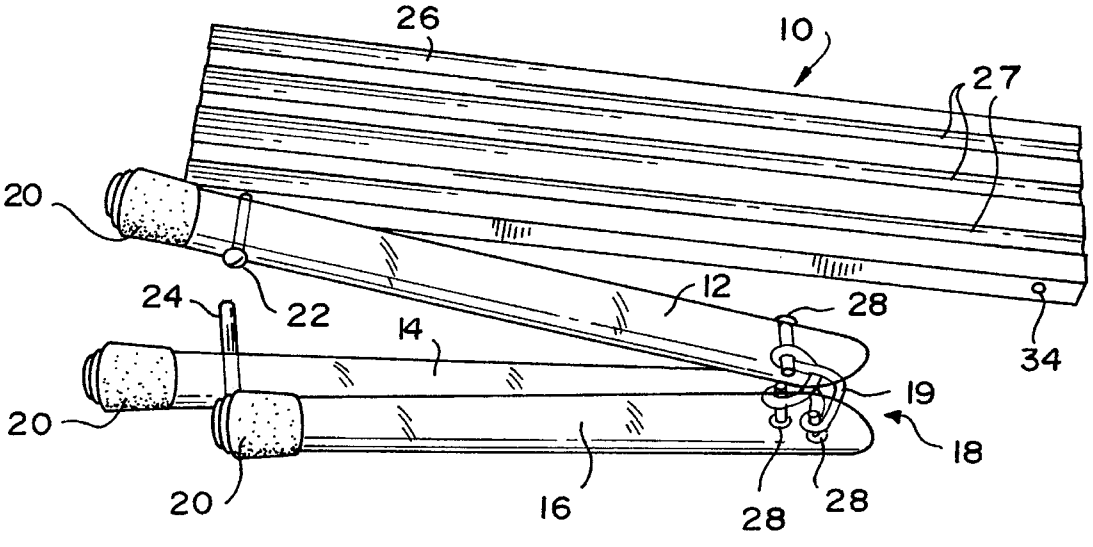
FIG. 6 is the bookstand in a folded position with all three legs almost parallel to the shelf.

Referring now to the manner in which legs 12, 14, and 16 are joined at apex 18, and referring to FIG. 4, there is provided on each leg a screw, or catch 28, located approximately a half inch from the apex. Wound around the catches 28 is an elastic loop 19 of sufficient tension to hold legs 12, 14, and 16 firmly together at their apex 18, yet of sufficient elasticity to allow the legs to be placed side-by-side longitudinally, as seen in FIG. 6.

As seen in the figures, the ends of the legs where they are joined at the apex 18 are vertically cut, i.e., to form an angle of approximately 45 degrees relative to the axis of each leg, so that the ends are in abutting relationship when joined by loop 19.

When not in use, the bookstand 10 would normally be stored in the closed compact position, occupying as little space as possible. When employing the bookstand 10 to support a book 30, the apex 18 is held in one hand and the shelf 26 is swung about peg 22 until opening 34 is in proximity to peg 24. Peg 24 is then inserted into opening 34, retaining shelf 26 in a horizontal position. Rear leg 16 may then be reclined to the preferred angle of the user. A book 30 is then placed on shelf 26 and book binder 31 positioned in the gap 32 to firmly retain it in position.

In the drawings and specifications, there have been disclosed typical preferred embodiments of the invention, and, although specific terms have been employed, they have been used in a generic and descriptive sense only and not for purpose of limitation, the scope of the invention being set forth in the following claims.

That which is claimed is:

1. A bookstand comprising a pyramidal frame having an apex and a base, said frame comprising at least three tubular legs, means interconnecting one end of said at least three legs in juxtaposition to form said apex of said frame, the legs extending divergently from the apex intersection thereof in a manner such that the other end of each of said legs comprise the base of said frame, catch means extending outwardly from each of said three legs each of said three legs near said one end, wherein said interconnecting means comprises elastic means wound about each of said catch means to interconnect said legs at their apex, and a shelf attached across one side of said frame, said shelf being adjacent to and extending across one side of the base of said frame in a manner to support books thereon in juxtaposition to lean against the side of said frame across which the shelf extends.

2. A bookstand as recited in claim 1, wherein two of said legs are of equal length, said shelf extending across said two legs and removably interconnected from one of said two legs.

3. A bookstand as recited in claim 2, wherein a third of said at least three legs is of shorter length than said two legs, permitting adjustable reclining of said bookstand.

4. A bookstand as recited in claim 3, further including means attached to the base of said at least three legs to provide friction between their bases and the surface upon which they rest.

5. A bookstand as recited in claim 4, wherein said legs are hinged at their apex, such that they may be folded to lay side by side in approximate parallel configuration along with said shelf when not in their open pyramidal position.

6. A bookstand as recited in claim 5, wherein said shelf is fixedly and rotatable secured to one of said two legs by a first peg, a second peg extending from the other of said two legs, said shelf having an opening at the other end thereof to receive said second peg therein so as to retain it in a horizontal position to support reading material thereon.

7. A bookstand as recited in claim 6, wherein a gap is formed between said shelf and said two legs to secure a binder of a book therein.

8. A bookstand as recited in claim 7, wherein said two legs form an angle of approximately 70 degrees relative to each other at their apex, and wherein said three legs are vertically cut at the ends joined at their apex at an angle of approximately 45 degrees relative to the axis of the legs so that their ends are in abutting relationship.

9. A bookstand, comprising:

at least three tubular legs;

means connecting said legs at one end to form an apex;

said legs capable of extending divergently at the other end to form a base for said bookstand;

a shelf attached between two of said legs to support material thereupon, said shelf fixedly and rotatably attached to only one of said two legs;

catch means located near the apex of each of said at least three legs, each of said catch means extending outwardly from each of said three legs; and means wound about each of said catches to interconnect said at least three legs.

10. A bookstand as recited in claim 9, further including material of a high coefficient of friction located at the bottoms of each leg.

11. A bookstand as recited in claim 10, wherein the legs attached to said shelf are longer in length than any other leg of the bookstand, permitting adjustable reclining of the bookstand.

12. A bookstand as recited in claim 11, further including a second peg extending from the second of said two legs, an opening located in the shelf to receive said second peg so as to retain the shelf in a horizontal position.

13. A bookstand as recited in claim 12, wherein said shelf is swingable about said one of said two legs, whereby the bookstand may be folded into a compact storage position, said shelf and legs being in an approximate parallel configuration.

14. A bookstand as recited in claim 13, wherein said high coefficient material comprises rubber, said legs comprise transparent acrylic, and said at least three legs comprises three legs.

15. A bookstand as recited in claim 8, wherein said two legs form an angle of approximately 70 degrees relative to each other at their apex, and wherein said three legs are vertically cut at the ends joined at their apex at an angle of approximately 45 degrees relative to the axis of the legs so that their ends are in abutting relationship.

* * * * *